United States Patent [19]

Nercessian

[11] 4,268,790

[45] May 19, 1981

[54] PROGRAMMABLE HIGH VOLTAGE POWER SUPPLY WITH NEGATIVE GROUND

[75] Inventor: Sarkis Nercessian, Flushing, N.Y.

[73] Assignee: Kepco, Inc., Flushing, N.Y.

[21] Appl. No.: 19,317

[22] Filed: Mar. 12, 1979

[51] Int. Cl.[3] ..... G05F 1/46

[52] U.S. Cl. ..... 323/318; 323/268; 323/350; 330/85

[58] Field of Search ..... 323/16, 19, 22 T, 23, 323/25, 40; 330/85, 98, 110

[56] References Cited

U.S. PATENT DOCUMENTS

| | | | |
|---|---|---|---|
| 3,470,457 | 9/1969 | Howlett | 323/22 T |
| 3,659,189 | 4/1972 | Kiviranna | 323/22 T |
| 3,747,008 | 7/1973 | Zaretsky | 330/110 |
| 3,864,624 | 2/1975 | Sugiyama et al. | 323/19 |

*Primary Examiner*—A. D. Pellinen

*Attorney, Agent, or Firm*—Alfred W. Barber

[57] ABSTRACT

Two high voltage power supplies programmable by external voltage and each having their positive output terminals as common are combined so that the output has the negative terminal grounded. Also the input programming voltage is applied referenced to ground.

4 Claims, 2 Drawing Figures

PROGRAMMABLE HIGH VOLTAGE POWER SUPPLY WITH NEGATIVE GROUND

Prior Art

High voltage programmable power supplies, programmable by external voltage, are designed to have a common terminal between the programming voltage input and the d-c output of the power supply. That terminal may be either the output positive terminal or the output negative terminal. In other words they often are so designed and constructed that only the designated terminal may be common with an external programming source and grounded. In some applications it may be desirable to have the other output terminal common and grounded for which a given power suppy was not designed.

Present Invention

It has been found that using two high voltage power supplies designed for a given common polarity, the opposite terminal may be grounded. The second power supply is used to program the first. For example, if the first power supply has a negative polarity output, the second power supply is connected with its common connected to this negative output point. The first power supply is operated with a fixed reference voltage and a feedback resistor of such value as to produce maximum output. The output of the second power supply is connected in series with the feedback resistor. The second power supply is programmed from zero to the maximum output of the first power supply. The output of the second power supply opposes the drop in the feedback resistor of the first power supply causing its output to go from maximum to zero when the output of the second power supply is programmed from zero to maximum. With this combination, the negative output terminal of the first power supply may be grounded. In the drawing:

Figure 1:
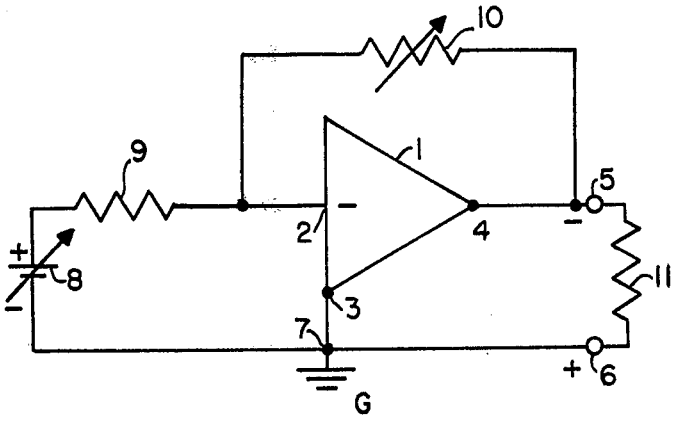
PRIOR ART FIG. 1
FIG. 1 is a block diagram of a typical prior art power supply.

FIG. 1 shows an operational amplifier (power supply) 1 having an inverting input terminal 2, a common terminal 3 and an output 4. The circuit includes a source of variable programming voltage 8, an input resistor 9 and a feedback resistor 10. Load 11 is connected between load terminals 5 and 6 which, in turn, are connected to output terminal 4 and common terminal 3 respectively. Common terminal 3 is connected to ground G at junction point 7. It will be seen that this power supply has its positive terminal connected to ground and that the source of programming voltage 8 is also returned to ground. This power supply is designed to operate with positive ground and if the negative terminal is grounded certain problems will be created such as the programming voltage return being to positive high voltage.

Figure 2:
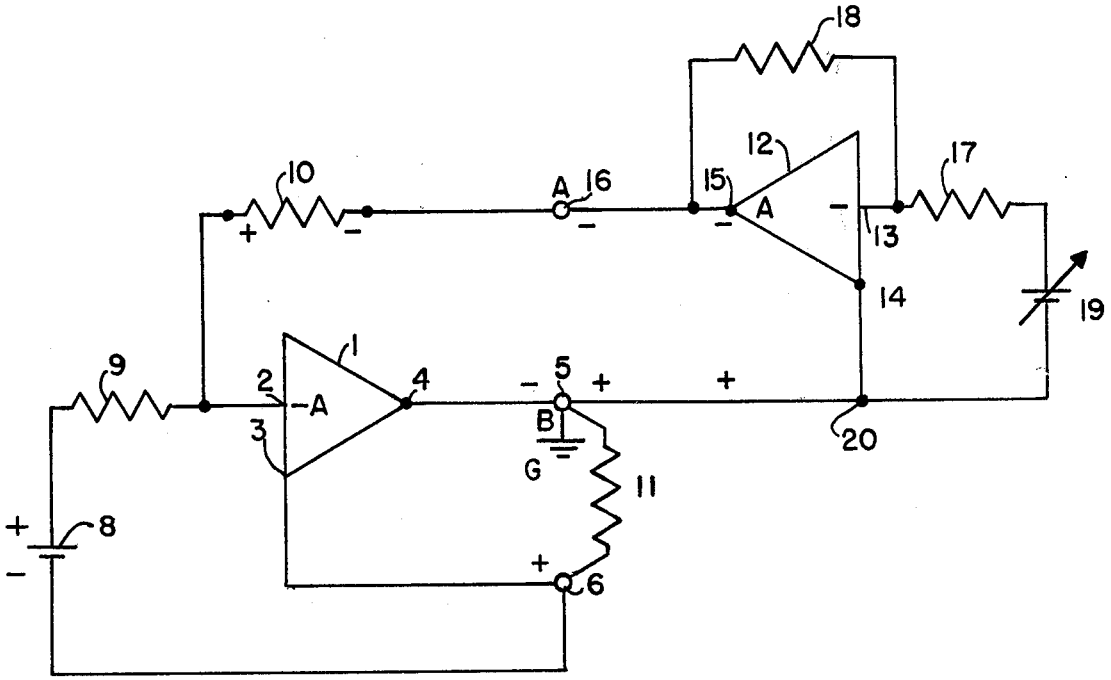
FIG. 2 is a block diagram of the preferred form of the invention.

FIG. 2 is a simplified block diagram of the preferred form of the present invention. The first power supply 1 is connected so that a fixed reference voltage 8, input resistor 9 and feedback resistor 10 would provide maximum output if resistor 10 were connected to output terminal 4. The current through resistor 10 would be 1 milliampere if resistor 10 were 5 megohms and the output voltage were 5000 volts. Also the output voltage of power supply 1 will be equal to the voltage between terminals 2 and 4 or 5 and in case of resistor 10 returned to 4, 5000 bolts. If we keep power supply 1 connected as shown but add a voltage source between the return of resistor 10 and output terminal 4 (5), the output voltage of power supply 1 will be 5000 volts minus the voltage of this added source. The added source is supplied by a second programmable power supply 12 capable of providing a maximum output of 5000 volts when provided with a suitable programming voltage 19, input resistor 17 and feedback resistor 18. Resistor 10 and the output terminal of the second source are joined at terminal 16 and common terminal 20 is connected to load terminal 5 (output terminal 4). The output voltage of power supply 1 and across load terminals 5 and 6 will be 5000 bolts less the output voltage of power supply 12 taken between output terminal 15 and common terminal 20. Load 11 is connected between load terminals 5 and 6.

It can be seen that with the above combination, terminal 5, the negative output terminal of power supply 1 may be grounded allowing the programming voltage source 19 to also be grounded. This permits the use of any convenient source of programming voltage as, for example, a remote source where it is always desirable to have one side grounded.

While only the preferred form of the present invention has been shown and described modifications are possible within the spirit and scope of the invention as set forth, in particular, in the appended claims.

I claim:

1. In a regulated power supply system, the combination of;

a first operational power supply including a first inverting input terminal, a first common terminal and a first output terminal;

a first load terminal connected to ground and said first output terminal;

a second load terminal connected to said first common terminal;

a first source of input voltage and a first input resistor connected between said first common terminal and said first inverting input terminal;

a second operational power supply including a second inverting input terminal, a second common terminal and a second output terminal;

a second source of input voltage and a second input resistor connected between said second common terminal and said second input terminal;

a first feedback resistor connected between said second input terminal and said second output terminal;

a second feedback resistor connected between said second output terminal and said first input terminal;

and a connection between said second common terminal and said first output terminal;

whereby the second common terminal and said first output terminal are at common ground polarity.

2. A regulated power supply system as set forth in claim 1, and;

wherein said first and second power supplies and the said first and second sources of input voltage are poled in a manner to provide the said first load terminal with positive polarity with respect to said second load terminal.

3. A regulated power supply system as set forth in claim 1, and;

wherein said first and second power supplies and the said first and second sources of input voltage are poled in a manner to provide said first load terminal with negative polarity with respect to said second load terminal.

4. A regulated power supply system as set forth in claim 1, and;

wherein said second source of input voltage is adapted to program the voltage across said first and second load terminals.

* * * * *